US007878143B2

(12) United States Patent
Yasui

(10) Patent No.: US 7,878,143 B2
(45) Date of Patent: Feb. 1, 2011

(54) FILM-FORMING APPARATUS, FILM-FORMING METHOD AND PARTICLE-SUPPLYING APPARATUS

(75) Inventor: Motohiro Yasui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 992 days.

(21) Appl. No.: 11/686,934

(22) Filed: Mar. 15, 2007

(65) Prior Publication Data

US 2007/0231480 A1 Oct. 4, 2007

(30) Foreign Application Priority Data

Mar. 28, 2006 (JP) ..... 2006-088565

(51) Int. Cl.
*B05C 11/00* (2006.01)
*B05C 19/00* (2006.01)
*B05B 17/00* (2006.01)
*B05B 7/26* (2006.01)

(52) U.S. Cl. ..... 118/308; 118/310; 118/684; 118/688; 118/303; 118/610

(58) Field of Classification Search ..... 118/308, 118/300, 665, 668, 684, 310, 712, 303, 309, 118/634, 50, 603, 610; 209/243; 427/180, 427/8

See application file for complete search history.

(56) References Cited

U.S. PATENT DOCUMENTS 5,746,320 A * 5/1998 Fujita et al. ..... 209/127.3
2004/0026030 A1* 2/2004 Hatono et al. ..... 156/279
2007/0122610 A1* 5/2007 Hatono et al. ..... 428/312.2

FOREIGN PATENT DOCUMENTS

JP 2003-293159 A 10/2003

* cited by examiner

*Primary Examiner*—Yewebdar T Tadesse
(74) *Attorney, Agent, or Firm*—Baker Botts L.L.P.

(57) ABSTRACT

A film-forming apparatus includes a mixing section which mixes material particles and core particles having a large particle size than that of the material particles; a separating section which separates the material particles and the core particles; an aerosol-generator which generates aerosol by dispersing the separated material particles in a carrier gas; and a nozzle which ejects the aerosol containing the material particles. The core particles having the large particle size can be easily controlled in terms of transport amount of the core particles, as compared to the material particles which are fine particles used for the film formation. Further, since the core particles hardly cause clog-up in the system, the concentration of aerosol can be maintained stably by appropriately controlling the transport amount of the core particles.

11 Claims, 7 Drawing Sheets

FILM-FORMING APPARATUS, FILM-FORMING METHOD AND PARTICLE-SUPPLYING APPARATUS

CROSS REFERENCE TO RELATED APPLICATION

The present application claims priority from Japanese Patent Application No. 2006-088565 filed on Mar. 28, 2006, the disclosure of which is incorporated herein by reference in its entirety.

BACKGROUND OF THE INVENTION

1. Field of the Invention

The present invention relates to a film-forming apparatus, a film-forming method and a particle-supplying apparatus.

2. Description of the Related Art

As a method for producing a piezoelectric actuator used, for example, for an ink-jet head of an ink-jet printer, there is a method called aerosol deposition method (AD method). In the AD method, an aerosol, in which fine particles of a piezoelectric material such as lead zirconate titanate (PZT) or the like are dispersed in a gas, is ejected (jetted) toward a surface of a substrate to make the fine particles collide against the substrate and to deposit the collided fine particles onto the substrate, thereby forming a film such as piezoelectric film or the like.

For example, Japanese Patent Application Laid-open No. 2003-293159 discloses an apparatus for forming the film by using such AD method. This apparatus includes an aerosol formation chamber for generating aerosol, a film-forming chamber for ejecting the generated aerosol to a substrate, and a nozzle provided inside the film-forming chamber. The aerosol, generated in the aerosol formation chamber, is introduced to the nozzle via a transport tube, and the aerosol is ejected through the nozzle toward the substrate.

In the AD method as described above, it is important to maintain the concentration of the aerosol (aerosol concentration) ejected from the nozzle to be constant, in view of forming a uniform film having satisfactory quality. However, it is difficult to stabilize the aerosol concentration due to many factors such as solidification of the aerosol in the aerosol formation chamber, clogging of particulate material in the transport tube and/or nozzle, and the like.

SUMMARY OF THE INVENTION

The present invention is made in view of the above-described situations, and an object of the present invention is to provide a film-forming apparatus and a film-forming method which are capable of easily controlling the concentration of aerosol ejected toward the substrate. Another object of the present invention is to provide a particle-supplying apparatus which supplies fine particles, such as particles forming aerosol or the like, while adjusting the supply amount of the fine particles.

According to a first aspect of the present invention, there is provided a film-forming apparatus which forms a film, including: a mixing section (mixer) which mixes material particles for forming the film and core particles having a particle size greater than that of the material particles to adhere the material particles onto each of the core particles; a separating section having a collision wall against which the core particles, each with the material particles adhered thereonto, collide to separate the material particles and the core particles; a transporting mechanism which transports each of the core particles, onto each of which the material particles adhered, from the mixing section to the separating section; an aerosol generator which is connected to the separating section and which generates an aerosol by dispersing the material particles, separated from each of the core particles at the collision wall, in a carrier gas; and a nozzle which is connected to the aerosol generator and which ejects the aerosol.

According to the first aspect of the present invention, in the mixing section, the material particles are adhered onto the surface of each of the core particles having particle size (particle diameter) greater than that of the material particles. Therefore, in this case, the clogging is less likely to occur than in a case in which only the material particles, having small or minute particle size, pass through the transporting mechanism. Accordingly, it is possible to transport the core particles, with the material particles adhered thereon, stably to the separating section, which in turn makes it possible to maintain, for example, the concentration of aerosol generated in the aerosol generator to be constant.

The film-forming apparatus of the present invention may further include a controller which is provided on the transporting mechanism and which controls a supply amount of the core particles to the separating section. In this case, for example, the aerosol concentration can be controlled by adjusting the amount of core particles having a relatively large particle size. Accordingly, it is possible to maintain, easily and assuredly, the concentration of the aerosol generated in the aerosol generator to be constant.

In the film-forming apparatus of the present invention, a fluidizer which generates a fluidized bed of the core particles may be provided between the mixing section and separating section.

In this case, the core particles, in each of which the material particles have been adhered on the surface thereof in the mixing section, are fluidized and agitated in the fluidizer. At this time, material particles, among the adhered material particles adhered onto the surface of each of the core particles, which are adhered to each of the core particles only weakly, are exfoliated (separated) from the core particle. As a result, only material particles, which are adhered firmly onto the surface of each of the core particles, remain on the surface of the core particle. In such a manner, by removing the material particles, which are adhered to the surface of each of the core particles excessively, before being transported to the separating section, it is possible to control the aerosol concentration with enhanced precision.

In the film-forming apparatus of the present invention, a sorter may be provided between the mixing section and the separating section, the sorter sorting, from a mixture containing the core and material particles mixed in the mixing section, the core particles onto each of which the material particles are adhered and free material particles, among the material particles, which are free from the core particles.

In this case, the sorter is provided between the mixing section and the separating section, the sorter sorting the core particles each having the material particles adhered thereon and the free material particles. Here, in the mixing section, not all the material particles are adhered to the core particles, and there still remains free material particles, which have not adhered to the core particles and are thus in a free state. Accordingly, by providing the sorter to sort the free material particles and the core particles onto which the material particles are adhered, it is possible to feed (supply) only the core particles onto which the material particles are adhered, thereby performing the aerosol concentration control with enhanced precision.

In the film-forming apparatus of the present invention, the sorter may be provided with a material recovering section which recovers the free material particles sorted by the sorter and which is connected to the mixing section to supply the recovered free material particles to the mixing section.

In this case, the sorter is provided with the material recovering section which recovers the free material particles sorted by the sorter, and the recovered free material particles are supplied from the material recovering section to the mixing section. Accordingly, the recovered material particles can be easily returned again to the aerosol generator (aerosol generating system), thereby making it easy to reuse the material particles.

In the film-forming apparatus of the present invention, the transporting mechanism may be connected to the separating section at a downstream-side portion of the transporting mechanism located at a position lower than that of an upstream-side portion thereof.

In this case, the transporting mechanism, which introduces the core particles to the separating section, is formed to have a height difference between the downstream-side portion reaching (connected) to the separating section, the downstream-side portion being located at the position lower than that of the upstream-side portion of the transporting mechanism. Here, in order to separate the material particles from the core particles, it is necessary to make the core particles collide against the collision wall with an appropriate collision force. In the present invention, however, the collision force by which the core particles collide against the collision wall can be easily adjusted by appropriately adjusting the height difference in the transporting mechanism between downstream-side and upstream-side portions thereof, at a position in front of the separating section (at a position before the core particles reach the separating section).

In the film-forming apparatus of the present invention, the separating section may be provided with a core recovering section connected to the mixing section, recovering the core particles from each of which the material particles have been separated, and supplying the recovered core particles to the mixing section.

In this case, the separating section is provided with the core recovering section recovering the core particles from each of which the material particles have been separated, and the core recovering section is connected to the mixing section to supply the recovered core particles to the mixing section. Accordingly, the recovered core particles can be easily returned again to the aerosol generating system, thereby making it easy to reuse the core particles.

In the film-forming apparatus of the present invention, the mixing section may be formed to have a down-slope which is declined, in a predetermined direction, from a supply position at which one of the core and material particles are supplied; and the core and the material particles may flow in the predetermined direction.

In this case, the mixing section is formed to have a down-slope which declines in the predetermined direction in which the core and material particles flow. Accordingly, both the material and core particles make contact with each other while both the particles are rolling down in the down-slope, and thus the material particles are coated entirely on the surface of each of the core particles in an uniform manner, thereby making adhesion amount (attaching amount), by which the material particles adhere or attach to each of the core particles, to be substantially uniform or equal among the core particles. In addition, the material particles adhere firmly to each of the core particles due to friction force and/or pressure generated between the core particles and the material particles and generated between the sloping surface of the mixing section and each of the core particles, which in turn makes it possible to prevent the material particles, adhered to each of the core particles once, from being exfoliated before reaching to the separating section. This makes it possible to stably supply the material particles by controlling the transport amount of the core particles.

In the film-forming apparatus of the present invention, an aerosol-concentration detector which detects a concentration of the aerosol may be provided between the aerosol generator and the nozzle.

In this case, since the aerosol-concentration detector is provided between the aerosol generator and the nozzle, the transport amount of the core particles can be adjusted by feeding back the detected aerosol concentration to the controller. This makes it possible to quickly respond to an unexpected change (fluctuation) in the aerosol concentration.

In the film-forming apparatus of the present invention, the mixing section may be provided with a flow-rate detector which detects a flow rate of the core particles.

In this case, since the mixing section is provided with the flow-rate detector which detects the flow rate of the core particles, the transport amount of the core particles can be adjusted by feeding back the detected flow rate of the core particles to the controller. This makes it possible to quickly respond to an unexpected fluctuation in the transport amount of the core particles.

In the film-forming apparatus of the present invention, the collision wall may be a mesh having a mesh size through which the core particles are passable; and the core recovering section may include another mesh having a mesh size through which the core particles are unable to pass.

In this case, the core particles can pass through the mesh as the collision wall whereas cannot pass through the mesh included in the core recovering section. Accordingly, the core particles can be recovered assuredly.

In the film-forming apparatus of the present invention, the controller may include a first adjusting valve which adjusts a supply amount of the core particles to the separating section, and a second adjusting valve which adjusts a supply amount of the material particles to the mixing section.

In this case, since the controller has the valves which independently adjust the supply amount of the core particles and the supply amount of the material particles respectively, the aerosol concentration can be controlled easily and assuredly.

In the film-forming apparatus of the present invention, each of the first and second adjusting valves may have a horizontal plate which adjusts a valve opening.

In this case, each of the first and second adjusting valves is of a type which adjusts the valve opening by advancing and retracting the horizontal plate. Accordingly, the supply amounts of the core and material particles can be controlled easily and linearly.

According to a second aspect of the present invention, there is provided a film-forming method for forming a film on a substrate, the method including: a mixing step for mixing material particles and core particles having a particle size greater than that of the material particles, and for adhering the material particles onto each of the core particles; a transporting step for transporting the core particles onto each of which the material particles are adhered in the mixing step, while controlling a transport amount of the core particles; a separating step for separating the material particles from each of the core particles by imparting an impact force to the core particles transported by the transporting step; an aerosol-generating step for generating an aerosol by dispersing, in a carrier gas, the material particles separated in the separating step from each of the core particles; and a film-forming step for forming a film of the material particles by ejecting the aerosol containing the material particles toward the substrate so that the material particles are adhered to the substrate to form the film.

According to the second aspect of the present invention, the material particles are adhered to each of the core particles having particle size greater than that of the material particles, and then the material particles are transferred while being adhered to each of the core particles, and then collision force is applied to the transported core particles with the material particles adhered thereon so as to separate the material particles from the core particles. Afterwards, the separated material particles are dispersed in the carrier gas to thereby generate aerosol. Here, the core particles, having a particle sizes which is large to some extent, can be easily controlled in view of the transport amount by which the core particles are transported in a system, as compared to the fine particles used for the film formation. In addition, the core particles are less likely to cause the clog-up. Accordingly, by appropriately controlling the transport amount of the core particles from the process of adhering the material particles to the core particles and through the process of separating the material particles from the core particles, it is possible to control the transport amount by which the core particles are transported to thereby control the supply amount by which the material particles are supplied, which consequently stabilizes the aerosol concentration.

In the film-forming method of the present invention, the material particles may have a primary mean particle size of not more than 1 μm; and the core particles may have a mean particle size in a range of 100 μm to 200 μm.

In this case, the material particles are particles having a primary mean particle size of not more than 1 μm; and the core particles are particles having a mean particle size in a range of 100 μm to 200 μm. Here, in the aerosol-generating step, it is necessary to form the aerosol by flying (scattering) only the material particles, among the material and core particles mutually separated, by a gas. Therefore, it is necessary to appropriately set a difference in size between the material and core particles. Further, when the core particles are too small in size, the core particles easily cause clog-up in the system, which in turn lowers the operation efficiency. Considering these situations, it is appropriate that the material particles are made to have the primary mean particle size of not more than 1 μm and that the core particles are made to have the mean particle size in the range of 100 μm to 200 μm. Note that the term "primary mean particle size" means a mean particle size in a state that the particles are not aggregated.

In the film-forming method of the present invention, a porous material may be used as the core particles.

In this case, since a porous material is used as the core particles, the material particles enter into fine pores of each of the core particles to firmly adhere to the core particle. Therefore, it is possible to prevent the material particles, once adhered to the core particles, from exfoliating before the material and core articles are processed (separated) in the separating step. Accordingly, the supply amount of the material particles can be stabilized by controlling the transport amount of the core particles.

In the film-forming method of the present invention, the core particles may be formed one of zirconia and alumina. In this case, since the core particles are made of zirconia or alumina, the core particles have sufficient hardness and are less likely to be worn. Accordingly, there is no fear that the core particles are chipped or partially scraped by the friction with the material particles.

In the film-forming method of the present invention, the material particles may be particles of lead zirconate titanate (PZT). In this case, since the material particles are made of a piezoelectric material such as PZT, it is possible to easily form a piezoelectric layer used, for example, in an ink-jet head of an ink-jet printer.

According to a third aspect of the present invention, there is provided a particle-supplying apparatus which supplies a plurality of first particles, including: a mixing section which mixes the plurality of first particles and a plurality of second particles having a particle size greater than that of the first particles, and which adheres the first particles onto each of the second particles; a separating section having a collision wall against which the second particles each with the first particles adhered thereonto collide to separate the first particles and the second particles; a transporting mechanism which transports each of the second particles, with the first particles adhered thereonto, from the mixing section to the separating section; and a controller which is provided on the transporting mechanism and which controls a supply amount of the second particles, each having the first particles adhered thereonto, to the separating section.

According to the third aspect of the present invention, the first particles are supplied to the separating section via the transporting mechanism in a state that the first particles are adhered to the surface of each of the second particles having the particles size greater than that of the first particles. Further, the transporting mechanism is provided with the controller which controls the supply amount by which the second particles, each having the first particles adhered thereon, are supplied to the separating section. Accordingly, the flow rate or the like of the first particles having a small particle size can be indirectly controlled by controlling the flow rate or the like of the second particles having a large particle size, rather than by directly controlling the flow rate or the like of the first particles having the small particle size. Therefore, the supply amount of the first particles, supplied from the particle-supplying apparatus, can be maintained stably.

DESCRIPTION OF THE PREFERRED EMBODIMENTS

In the following, the present invention will be explained in detail by an embodiment thereof with reference to FIGS. 1 to 4.

Figure 1:
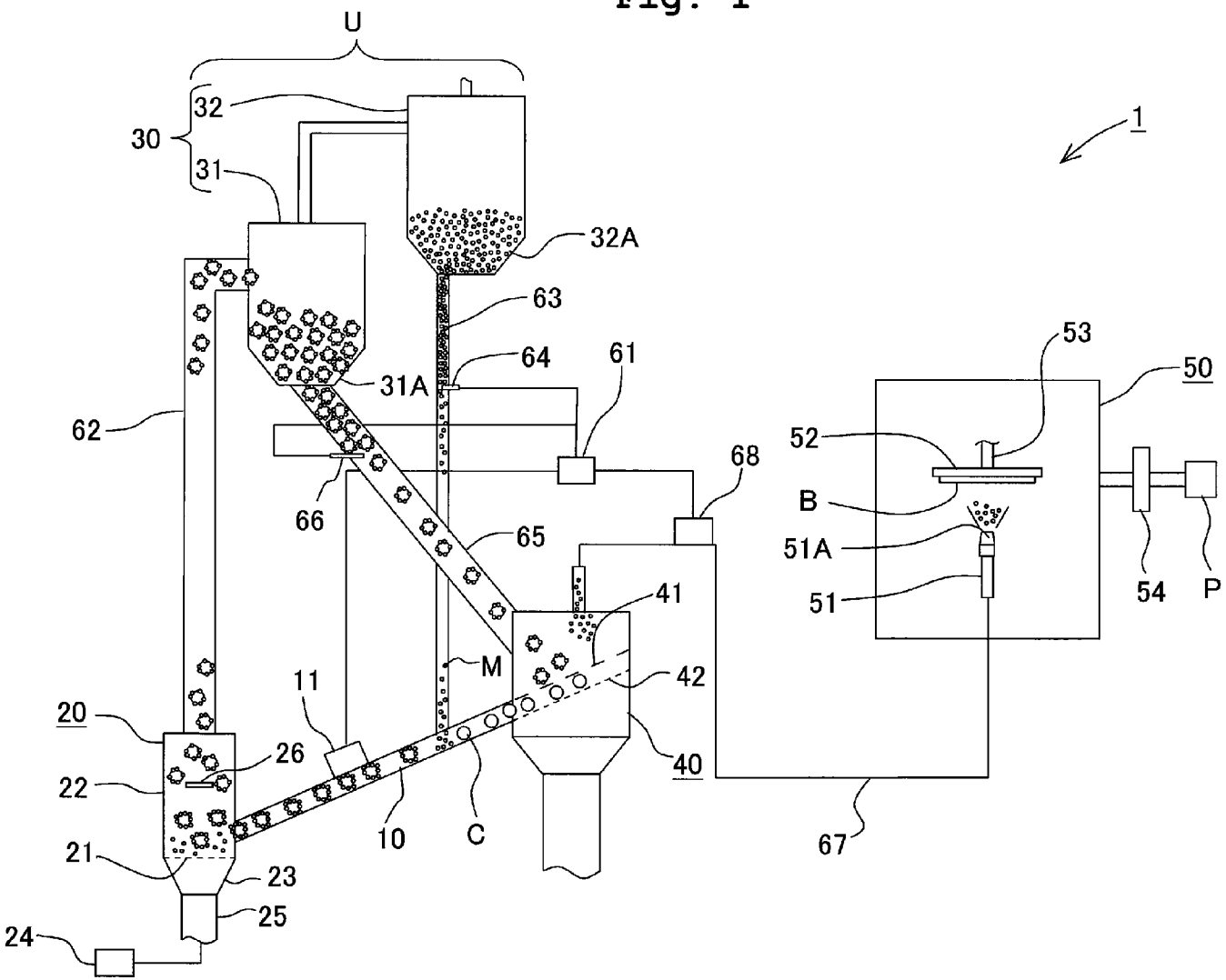
FIG. 1 is a schematic view of a film-forming apparatus according to an embodiment of the present invention.
Figure 2:
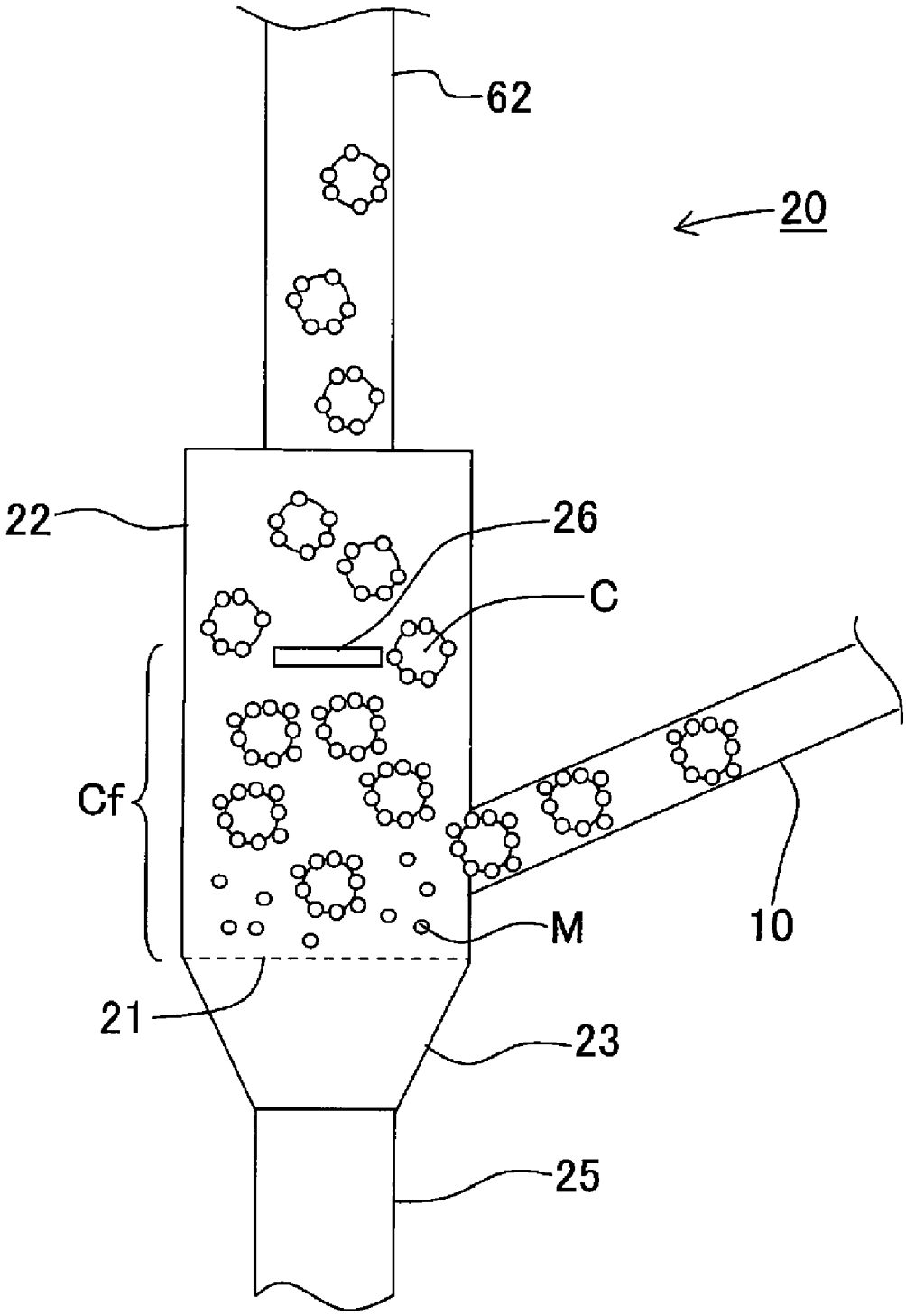
FIG. 2 is a schematic cross-sectional view of a fluidizer according to the embodiment.
Figure 3:
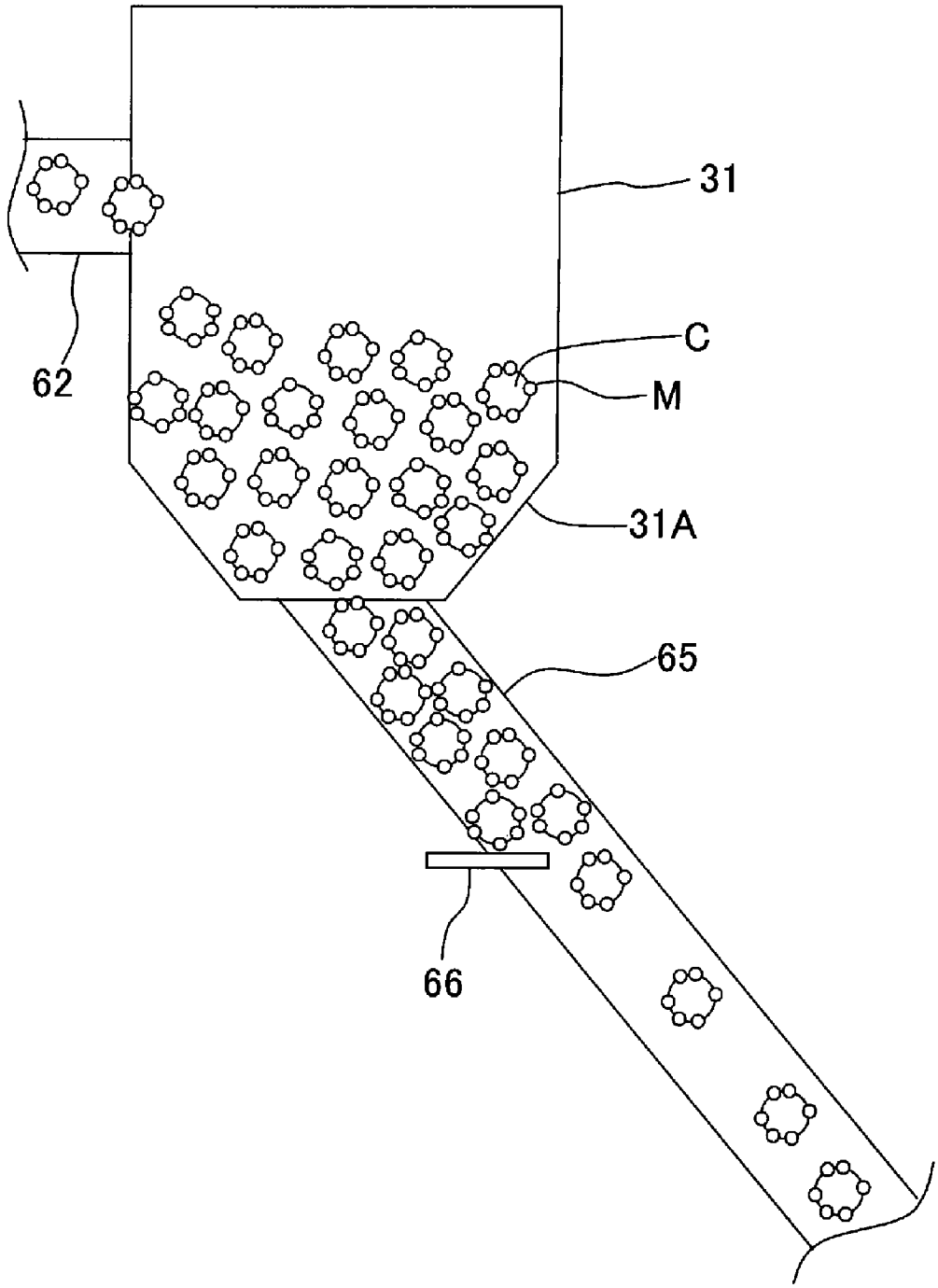
FIG. 3 is a schematic cross-sectional view of a cyclone according to the embodiment.
Figure 4:
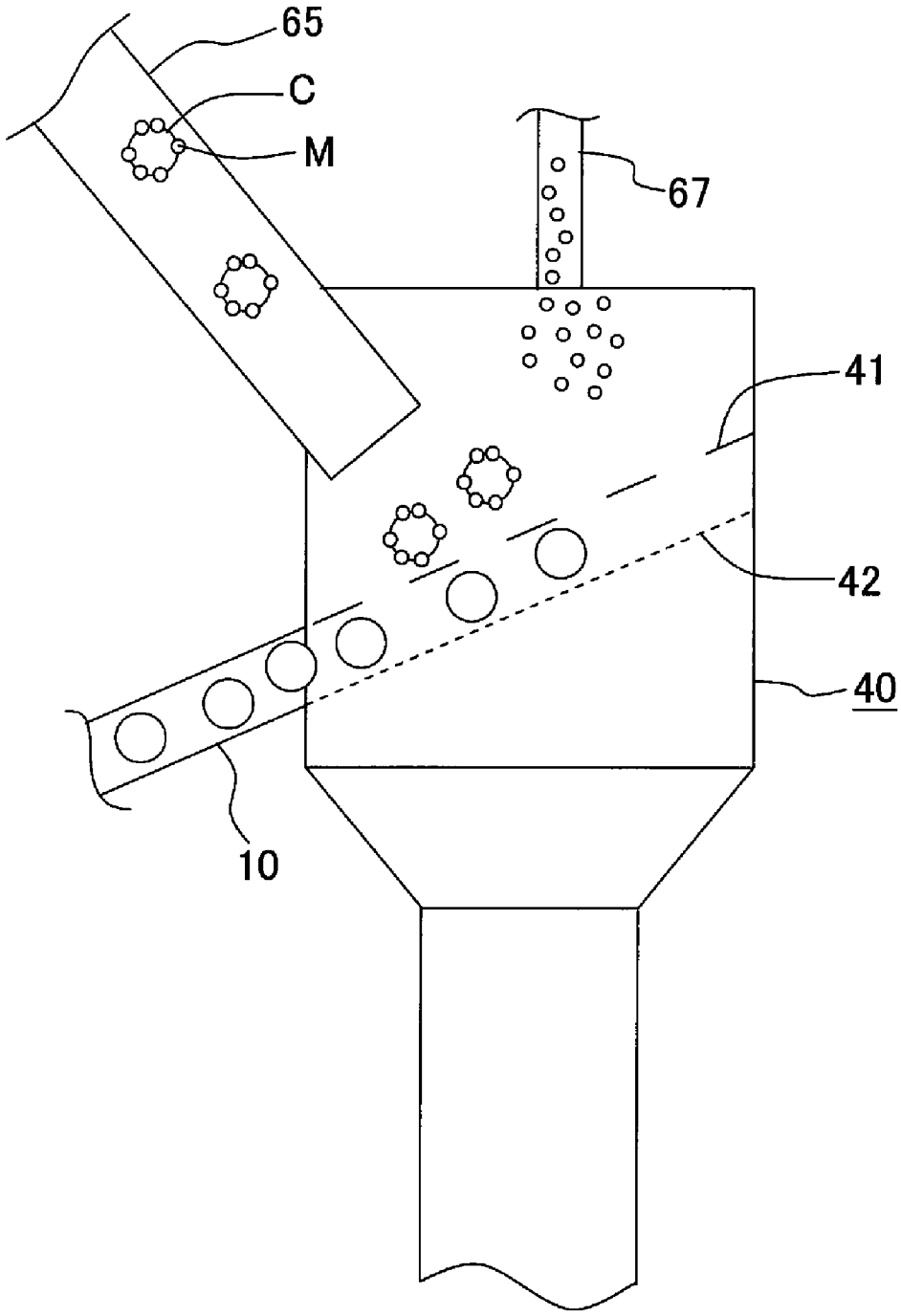
FIG. 4 is a schematic cross-sectional view of an aerosol generator according to the embodiment.

FIG. 1 shows a film-forming apparatus 1 according to an embodiment of the present invention. The film-forming apparatus 1 is provided with an aerosol supply unit U for generating aerosol, a nozzle 51 for ejecting the generated aerosol, and a film-forming chamber 50 for making the aerosol ejected from the nozzle 51 to adhere to a substrate B.

As shown in FIG. 1, the aerosol supply unit U is constructed as a circulation route of core particles C, and includes a mixing section 10 which mixes material particles M and the core particles C to adhere the material particles M to surface of each of the core particles C; an aerosol generating tank 40 (aerosol generator) which is connected to an upstream portion of the mixing section 10, which separates the material particles M from each of the core particles C, and which disperses the separated material particles M in a carrier gas to generate an aerosol; and a transporting mechanism (fluidizer 20, delivery tube 62 and transport tube 65) which connects a downstream portion of the mixing section 10 and the aerosol generating tank 40.

The mixing section 10 is formed in a tubular form and is arranged to slope (incline) downwardly in a predetermined direction (toward the left side in FIG. 1). In other words, the mixing section 10 is arranged to be inclined from the upstream to downstream of a flow direction in which the core particles C flow. As will be described later on, the mixing section 10 is connected to the aerosol generating tank 40 at one end (upstream end) of the mixing section 10, and the core particles C, separated from the material particles M in the aerosol generating tank 40, are supplied to the mixing section 10. In the mixing section 10, a material supply tube 63 (material supply channel) is connected to the mixing section 10 at a portion thereof located somewhat nearer to the downstream than its upstream end. Further, in the mixing section 10, a flow rate detector (flowmeter) 11 is connected to the mixing section 10 at another portion thereof located somewhat nearer to the downstream than the portion at which the material supply tube 63 is connected to the mixing section 10. The flow rate detector 11 detects the flow rate of the core particles C flowing through the mixing section 10.

The downstream end of the mixing section 10 is connected to a fluidizer 20. The fluidizer 20 is formed to have a substantially tubular form with an inner diameter of about 150 mm. The inside of the fluidizer 20 is partitioned with a distribution plate 21 so that a fluidized-bed chamber 22 is formed on the upper side and an air box 23 is formed on the lower side of the fluidizer 20. The distribution plate 21 has a large number of fine pores having a pore size which allows the carrier gas pass therethrough but does not allow the core particles pass therethrough. As the distribution plate 21, it is possible to use, for example, a porous sintered body or a multi-nozzle plate having a large number of nozzles formed therein. The distribution plate 21 is provided in the fluidized-bed chamber 22 at a position located slightly lower than a position at which the mixing section 10 is connected to the fluidized-bed chamber 22, and the core particles 10 and the material particles M flowed from the mixing section 10 to the fluidizer 20 are supplied to the fluidized-bed chamber 22. A particle-scattering preventive plate 26 is provided at a position below an outlet piping (a delivery tube 62 to be described later) which is arranged above the fluidized-bed chamber 22 and substantially at the center in the axial direction of the fluidized-bed chamber 22. The particle-scattering preventive plate 26 has a function to prevent huge particles, such as particles formed of plurality of the aggregated core particles C or the like, which can jump from fluidized core particles C (will be described later) from entering into the outlet piping. Thus, by providing the particle-scattering preventive plate 26 in the fluidized-bed chamber 22 at the position below the outlet piping, it is possible to transport only the dispersed core particles C (core particles C onto which the material particles M are adhered) to a sorter 30 (will be described later) through the delivery tube 62. In addition, an air supply unit 24 which supplies the carrier gas to the fluidizer 20 is connected to the bottom portion of the air box 23 via a gas supply tube 25. When the carrier gas is supplied to the fluidized-bed chamber 22 via the gas supply tube 25 and the air box 23, then the core particles C, fed from the mixing section 10, are fluidized.

The delivery tube 62, through which the core particles C are delivered to the sorter 30 by an airflow, is connected to the fluidized-bed chamber 22. The delivery tube 62 has an inner diameter of about 28 mm. An end of the delivery tube 62 is inserted to the fluidized-bed chamber 22 from an opening of the fluidized-bed chamber 22 formed at the upper side thereof, and a fluidized bed Cf is formed between the distribution plate 21 and the one end of the delivery tube 62. The other end of the delivery tube 62 is extended upwardly and is connected to the sorter 30 arranged at a position above the fluidizer 20.

The sorter 30 sorts and collects (recovers) the core particles C with the material particles M adhered thereon and the material particles (free material particles) M which have not adhered to the core particles C. The sorter 30 includes a known cyclone 31 and a known bag filter (material recovering section) 32 connected to the lower stage of the cyclone 31. The cyclone 31 is capable of recovering only the core particles C having a large particle size, and the bag filter 32 is capable of recovering the free material particles M having a small particle size.

A core feed hopper 31A is provided on the bottom portion of the cyclone 31 and is capable of discharging the recovered core particles C therefrom. A transport tube 65 is extended from a lower portion of the core feed hopper 31A, and an end of the transport tube 65 is connected to the aerosol generating tank 40. The transport tube 65 extends, from an outlet formed in the core feed hopper 31A, in an obliquely downward direction toward the aerosol generating tank 40 arranged at a position downwardly oblique to the core feed hopper 31A. Thus, the core particles C are fed to the aerosol generating tank 40 by freely falling from the cyclone 31 through the transport tube 65. Note that the core feed hopper 31A may be provided independently from the cyclone 31, and may be connected to the cyclone 31 via a tube. The transport tube 65 is provided with a transport-adjusting valve (first adjusting valve) 66 which adjusts a falling amount by which the core particles C fall. The transport-adjusting valve 66 adjusts the valve-opening (channel area of transport tube) by advancing (inserting) and retracting a horizontal plate to thereby adjust the flow rate of the core particles C. When such a valve utilizing advancement/retraction of the horizontal plate is used, it is possible to linearly control the valve opening. Therefore, the supply amount of the core particles C can be controlled more easily as compared to a case in which a butterfly valve, a ball valve or the like is used.

The aerosol generating tank 40 is formed in a container shape having a bottom surface, and an end (downstream end) of the transport tube 65 is inserted to the inside of the aerosol generating tank 40. Further, a collision net (collision wall) 41 and a recovery net (core recovering section) 42 are provided inside the aerosol generating tank 40. The collision net 41 is formed of a net having a mesh size which is approximately same as a mean particle size of the core particles C, and is arranged in an obliquely inclined posture at a position below the downstream end of the transport tube 65. The collision net 41 is capable of separating, by the impact of the collision, the material particles M from the core particles C. Further, the recovery net 42 is formed of a net having a mesh size which is smaller than the mean particle size of the core particles C, and is arranged in an obliquely inclined posture at a position below the collision net 41 with a distance to some extent from the collision net 41. The recovery net 42 is capable of recovering the core particles C after the material particles M have been separated therefrom. Further, to the aerosol generating tank 40, the upstream end of the mixing section 10 is connected. The recovery net 42 is arranged in a side wall portion of the aerosol generating tank 40 such that a downward end of the recovery net 42 is aligned with the connecting position at which the mixture 10 is connected to the aerosol generating tank 40. By arranging the recovery net 42 in this manner, it is possible to make the recovered core particles C flow into the mixing section 10.

An aerosol supply tube 67 is connected, at an end thereof, to the ceiling of the aerosol generating tank 40. The aerosol supply tube 67 supplies aerosol generated in the aerosol generating tank 40 to the ejection nozzle 51. An aerosol concentration detector 68, which is capable of detecting concentration of the aerosol passing through the aerosol supply tube 67, is attached to the aerosol supply tube 67.

The bag filter 32 is connected to the mixing section 10 via a material supply tube (material supply channel) 63. A material feed hopper 32A is provided on a bottom portion of the bag filter 32, and the free material particles M, which have been recovered, can be discharged from the material feed hopper 32A. The material supply tube 63 is extended from a lower portion of the material feed hopper 32A, and an end of the material supply tube 63 is connected to the mixing section 10. The material supply tube 63 is extended, from an outlet of the material supply hopper 32A, downwardly toward the mixing section 10, and the material particles M are delivered to the mixing section 10 by freely falling from the bag filter 32 through the material supply tube 63. Note that the material feed hopper 32A may be provided independently from the bag filter 32, and may be connected to the bag filter 32 via a tube. The material supply tube 63 is further provided with a supply-adjusting valve (second adjusting valve) 64 which adjusts a falling amount by which the material particles M falls. The supply-adjusting valve 64 adjusts the valve-opening of the transport valve 65 by advancing and retracting a horizontal plate to thereby adjust the flow rate of the material particles M, similar to the transport-adjusting valve 66 provided on the transport tube 65.

Next, the film-forming chamber 50 will be explained. The film-forming chamber 50 is formed in a substantially rectangular parallelepiped (cuboid) shape, and a stage 52 for attaching a substrate B thereto and an ejection nozzle (nozzle) 51 arranged below the stage 52 are provided inside the film-forming chamber 50. The ejection nozzle 51 is formed in a circular-cylindrical shape and has openings formed at upper and lower ends thereof respectively. The upper opening of the ejection nozzle 51 is a slit-shaped ejection port 51A, and the other opening on the lower side is connected to an end of the aerosol supply tube 67, and the aerosol generated in the aerosol generating tank 40 is supplied to the ejection nozzle 51 through the aerosol supply tube 67.

The stage 52 is formed in a rectangular-plate shape, and is suspended by a stage moving mechanism 53 in a horizontal posture from the ceiling of the film-forming chamber 50, and the stage 52 is capable of holding the substrate B on its lower surface. The stage moving mechanism 53 is driven in accordance with a command from an unillustrated controller, and moves the stage 52 in a direction of the plane thereof (within a plane parallel to the plate surface of the stage 52). This makes it possible to move the ejection nozzle 51 relative to the substrate B.

Further, a vacuum pump P is connected to the film-forming chamber 50 via a powder recovery unit 54 so that the inside of the film-forming chamber 50 can be decompressed by the vacuum pump P.

Further, a controller 61 is provided on the film-forming apparatus 1. The controller 61 has a built-in micro computer which stores a control program for controlling the operation of the film-forming apparatus 1. Information from the flow rate detector 11 and information from the aerosol concentration detector 68 are inputted to the controller 61, and a signal for controlling the supply-adjusting valve 64 and a signal for controlling the transport-adjusting valve 66 are outputted by the controller 61.

Figure 5:
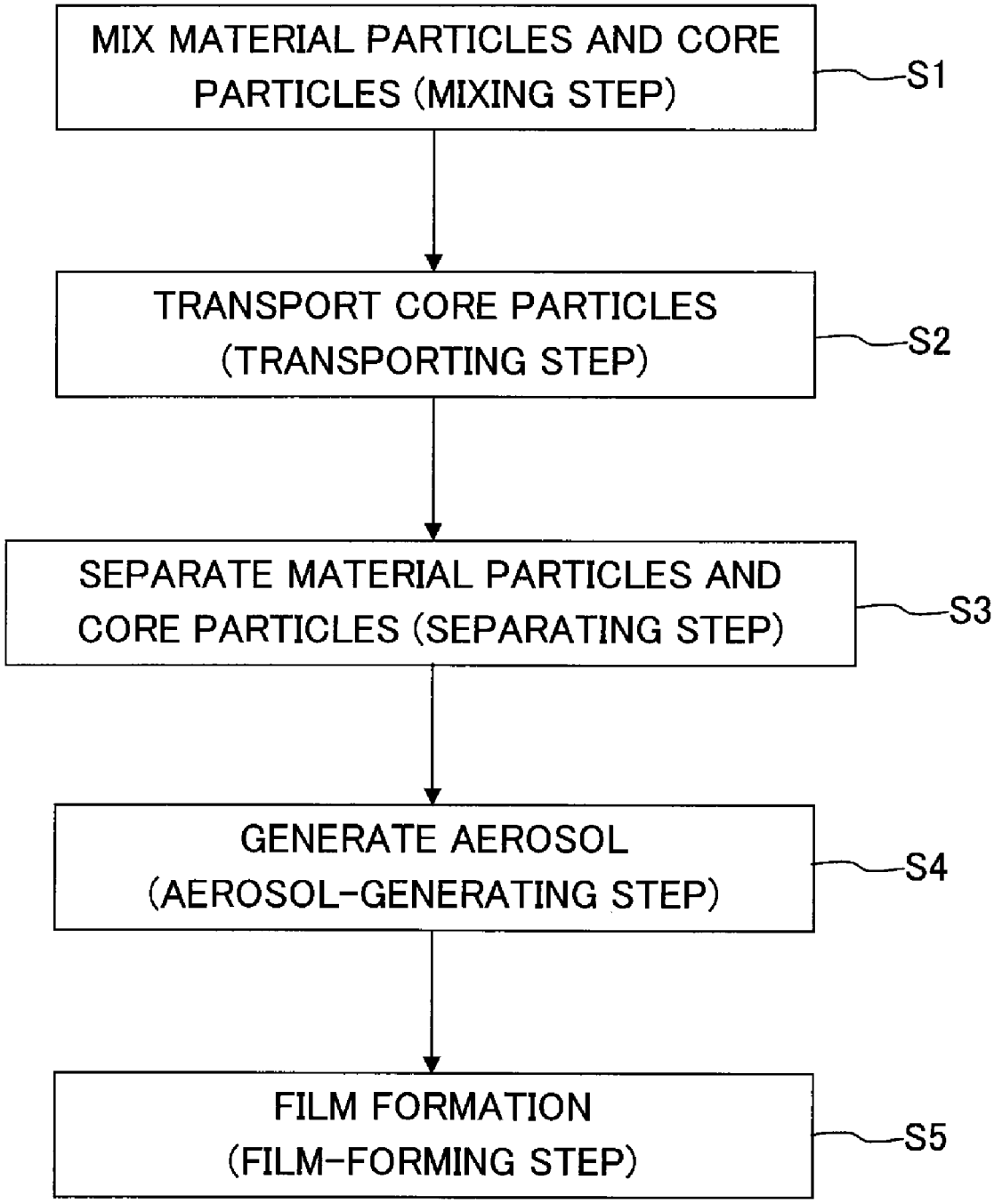
FIG. 5 is a flow chart showing a film-forming method of the present invention.

Next, steps for forming a film with the film-forming apparatus 1 will be explained with reference to a flow chart shown in FIG. 5.

It is preferable to use, as the core particles C used in the embodiment, a porous material provided with a large number of fine pores for holding the material particles M. Further, the core particles C preferably have a mean particle size to an extent that the core particles hardly cause the clog-up in the system, and that the flow rate can be monitored (grasped) and controlled easily. Accordingly, it is most appropriate that the mean particle size is not less than 100 μm and not more than 200 μm. Further, the core particles C preferably have a hardness of not less than 500 HV so that the core particles C are not chipped in various steps which will be described later on. Furthermore, the core particles C preferably is nonreactive or weakly reactive with respect to the material particles M. Suitable porous material for the core particles C can be exemplified, for example, by ceramics material including alumina, zirconia, and the like. On the other hand, there is no limitation to the material particles M provided that the particles are applicable to the film formation with the aerosol deposition method (AD method). For example, when it is desired to form a piezoelectric film, fine particles of a piezoelectric material such as lead zirconate titanate (PZT) can be used. Alternatively, the material particles may be formed of lead magnesium niobate (PMN). On the other hand, when an insulating film is to be formed, it is possible to use fine particles of an insulating material such as alumina and/or zirconia. When a metallic film is to be formed, it is possible to use fine particles of a metal such as gold, platinum, and the like. An appropriate primary mean particle size of the material particles M, namely a mean particle size in a state that the material particles M are not aggregated (in a non-aggregated state), is not more than 1 μm, and preferably is in a range of 0.1 μm to 1 μm because it is preferable that the size of the material particles M is appropriately small than that of the core particles C. Note that the primary mean particles size can be measured, for example, with the following methods: (i) method for measuring particle size by dispersing particles in a liquid, irradiating laser beam to the particles moving by the Brownian movement, and observing the light scattered from the particles to thereby measure the particle size; (ii) method for measuring particle size by dispersing particles in a flow passage with a gas by a dry method while imparting shearing force to the particles so as to measure the particle size in a similar manner as the method of (i); and (iii) method for measuring mean particle size by recording images of particles dispersed with the two methods (i) and (ii) respectively, or by recording an image of particles captured in a passage from the aerosol generating tank 40 up to the substrate B, and then by obtaining the mean particle size based on data of the images.

When the operation of the film-forming apparatus 1 is initiated, first, the material particles M and the core particles C are mixed in the mixing section 10 (mixing step S1). When the core particles C are supplied to the mixing section 10, the core particles C fall while rolling down from the upstream to the downstream due to because the mixing section 10 is inclined. At this time, also the material particles M are supplied from the material supply tube 63 to the mixing section 10. The material particles M adhere to surface of each of the core particles C in a process that the material particles M roll down, together with the core particles C, along the down-slop of the mixing section 10. The material particles M, adhered to the surface of each of the core particles C, are pushed against the surface of each of the core particles C in a space between the inner wall of the mixing section 10 and the surface of each of the core particles C, and are thereby squeezed or pushed into the fine pores of the core particle C to be fixed therein. In such a manner, through a process in which the material particles M are coated (smeared) onto the core particles C while the core and material particles are rolled down in a passage having a down-slope, an amount by which the material particles M are incorporated in the fine pores of each of the core particles C (adhesion amount) is substantially averaged among the core particles C. Note that the flow rate of the core particles C in the mixing section 10 is monitored by the flow rate detector 11.

The core particles C, onto each of which the material particles M are adhered, are fed to the fluidized-bed chamber 22 of the fluidizer 20. In the fluidized-bed chamber 22, the core particles C are fluidized by a carrier gas supplied to the fluidized-bed chamber 22, thereby forming a fluidized bed Cf between the distribution plate 21 and the delivery tube 62. At this time, free material particles M not adhered to the core particles C are scattered, riding along a flow of the carrier gas. Therefore, only the core particles C form the fluidized bed Cf.

In addition, since the core particles C move violently in the fluidized bed Cf, material particles M, among the adhered material particle M, which adhere weakly to the surface of each of the core particles C are removed or exfoliated off from the core particle C, and only material particles M adhered relatively strongly to the fine pores of the core particle C remain adhered to the core particle C. With this, an amount, by which the material particles M are held to the core particle C, is further averaged among the core particles C. In this manner, the adhesion amount by which the material particles M firmly adhere to the core particles C is approximately averaged by the mixing section 10 and the fluidizer 20. Accordingly, the flow rate of the core particles C in the mixing section 10 is highly correlated with the supply amount by which the material particles M adhered to the core particles C and supplied to the aerosol generating tank 40. In other words, the flow rate of the core particles C in the system is highly correlated with the concentration of the resulting aerosol. Accordingly, it is possible to easily control the aerosol concentration by controlling the flow rate of the core particles C which can be easily controlled and monitored and which have a particle size relatively great as compare with the material particles M.

By continuously supplying the carrier gas and the core particles C to the fluidized bed Cf, the core particles C are overflowed little by little from the fluidized bed Cf, and the core particles C are ascended in the delivery tube 62, riding the current of the carrier gas, and are delivered to the sorter 30. In the sorter 30, first, the core particles C having a large particle size are recovered in the cyclone 31 which is the upper stage device of the sorter 30. The free material particles M, having a small particle size, are flowed together with the carrier gas to the bag filter 32 which is the lower stage device of the sorter 30, and the free material particles M are recovered in this bag filter 32. In this manner, the core particles C onto which the material particles M are adhered and the free material particles M are sorted. By doing so, in the separating and aerosol-generating steps which will be described later, no free material particles M are delivered as being mixed with the core particles C. Therefore, it is possible to control the transport amount of the core particles C, which in turn makes it possible to assuredly control the concentration of the resulting aerosol.

The core particles C, recovered in the cyclone 31, are discharged from the core feed hopper 31A, and delivered to the aerosol generating tank 40 by freely falling in the transport tube 65. At this time, the falling amount of the core particles C is adjusted by the opening adjusting mechanism with the advancement/retraction of the horizontal plate provided on the transport-adjusting valve 66. The transport of the core particles C from the fluidizer 20 to the aerosol generating tank 40 corresponds to the transporting step S2 of the present invention.

In the aerosol generating tank 40, the core particles C delivered through the transport tube 65 collide against the collision net 41. The impact of the collision separates the material particles M adhered to the core particles C from the core particles C (separating step S3). Note that it is necessary to make the core particles C collide against the collision net 41 at an appropriate speed so as to separate the material particles M from the core particles C. For this purpose, in the embodiment, the cyclone 31 disposed upstream of the collision net 41 is arranged at a position higher than the collision net 41, and the transport tube 65 which is arranged between the collision net 41 and the cyclone 31 is arranged to be inclined such that the collision net 41 is inclined downwardly from the side of the cyclone 31 (upstream side) toward the side of the collision net 41 (downstream side), reaching to the aerosol generating chamber 40. In this manner, the transport tube 65 is arranged such that an end thereof on the side of the collision net 41, the end being the terminal end of the transporting mechanism, is located at a position lower than the other end of the transport tube 65, the other end being on the side of the cyclone 31 which is on the upstream side. The falling speed at which the core particles C fall through the transport tube 65 can be controlled by providing a height different between the both ends of the transport tube 65 in such a manner and by appropriately setting the magnitude of the height different, the inclination of the transport tube 65, and/or the like. Accordingly, it is possible to easily adjust the impact generated when the core particles C collide against the collision net 41. Further, since the transport tube 65 is provided with the transport-adjusting valve 66, the falling amount of the core particles C can be controlled, which in turn makes it possible to control the concentration of the aerosol generated in the aerosol generating tank 40.

Among the core and material particles C, M which are separated from each other, the material particles M having a small particle size and a light weight are lifted up by the carrier gas to be dispersed, forming the aerosol (aerosol-generating step S4). The generated aerosol is supplied (delivered) to the film-forming chamber 50. Namely, when the inside of the film-forming chamber 50 is depressurized by the vacuum pump P, pressure difference is generated between the aerosol generating tank 40 and the film-forming chamber 50, thereby sucking the aerosol into the aerosol supply tube 67. The aerosol is then delivered to the ejection nozzle 51 while being accelerated at a high speed. The concentration of the aerosol delivered from the aerosol generating tank 40 to the ejection nozzle 51 is monitored by the aerosol concentration detector 68 attached to the aerosol supply tube 67.

The aerosol delivered to the ejection nozzle 51 is ejected toward the substrate B through the ejection port 51A. The material particles M, contained in the ejected aerosol, collide against the substrate B to deposit on the substrate B. The material particles M firmly fixed onto the substrate B in such a manner form a piezoelectric film (film-forming step S5). At this time, the aerosol is blown while changing little by little a position of the ejection nozzle 51 relative to the substrate B by moving the stage 52 by the stage moving mechanism 53. By doing so, the film is formed entirely on a surface of the substrate B.

The aerosol, which contains the material particles M which were not deposited on the substrate B after colliding against the substrate B, is discharged toward the powder recovery unit 54 by suction force of the vacuum pump P.

On the other hand, the core particles C which are heavy and have a large particle size fall through the mesh of the collision net 41 toward the recovery net 42 stretched below the collision net 41, without being lifted up by the carrier gas. The core particles C can be recovered on the recovery net 42 because the mesh of the recover net 42 is set to a size not allowing the core particles C to pass therethrough. The core particles C roll down along the inclination of the recovery net 42, and are supplied to the mixing section 10 arranged at the side of the down-slope end of the recovery net 42, so that the core particles C are reused.

The free material particles M, recovered in the bag filter 32, are discharged from the material feed hopper 32A, and fall freely in the material supply tube 63 to be supplied to the mixing section 10, so that the free material particles M are reused. The supply-adjusting valve 64 is provided on the material supply tube 63, and adjusts the valve opening with the advancement/retraction of the horizontal plate to thereby adjust the flow rate of the material particles M, similarly to the transport-adjusting valve 66.

The transport-adjusting valve 66 and the supply-adjusting valve 64 are connected to the controller 61, and the opening of these valves are automatically controlled by signals from the controller 61. Information about the flow rate of the core particles C, in the mixing section 10, detected by the flow rate detector 11 and information about the concentration of the aerosol, in the aerosol supply tube 67, detected by the aerosol concentration detector 68, are sent to the controller 61 which in turn performs valve-opening control for the transport-adjusting valve 66 based on these informations. In such a manner, by adjusting the flow rate of the core particles C in the circulation route, the aerosol concentration can be stabilized. In addition, the controller 61 performs the valve-opening control for the supply-adjusting valve 64 in conjunction with the valve-opening control for the transport-adjusting valve 66. With this, the supply amount of the material particles M can be adjusted in accordance with the flow rate of the core particle C.

According to the embodiment as described above, the material particles M are adhered, in the mixing section 10, to the core particles C having a particle size greater than the material particles M, and then the core particles C with the material particles M adhered thereon are transported to the aerosol generating tank 40, followed by being made to collide against the collision net 41, thereby separating the material particles M from the core particles C by the impact of the collision. Afterwards, the separated material particles M are dispersed in the carrier gas in the aerosol generating tank 40, thereby generating the aerosol.

Here, the core particles C having a large particle size to some extent hardly causes clog-up and can be easily controlled in view of the transport amount in the transport passage, as compared with the material particles M having a fine particle size and used for the film formation. Accordingly, by appropriately controlling the transport amount of the core particles C from the process for making the material particles M adhere to the core particles C through the process for separating the material particles M from the core particles C, instead of directly controlling the transport amount of the material particles M in these processes, it is possible to control the supply amount of the material particles M to the aerosol generating tank 40 and consequently to stabilize the aerosol concentration.

Further, the fluidizer 20 is provided at an intermediate position in the transporting route from the mixing section 10 to the aerosol generating tank 40 so that the core particles C are fluidized to form the fluidized bed Cf. In the fluidizer 20, the core particles C, with the material particles M adhered on the surface thereof in the mixing section 10, are fluidized and agitated. At this time, the material particles M adhering to the surface of the core particles weakly are exfoliated from the core particle C. In such a manner, the material particles M, which adhere to the surfaces of the core particles excessively, are removed before being delivered to the aerosol generating tank 40, thereby making it possible to perform the aerosol concentration control with enhanced precision.

Moreover, the sorter 30, which sorts the core particles C with the material particles M adhered thereon and the free material particles M, is provided also at an intermediate position in the transporting route from the mixing section 10 to the aerosol generating tank 40 (more specifically, at a position between the fluidizer 20 and the aerosol generating tank 40). In the mixing section 10, not all the material particles M adhere to the core particles C, and there remains free the material particles M, among the material particles M, which were unable to adhere to the core particles. By providing the sorter 30 to sort the free material particles M and the core particles C having the material particles M adhered thereon, it is possible to feed, to the aerosol generating tank 40, only the core particles M with the material particles M adhered thereon. With this, the precision of the aerosol concentration control can be enhanced.

Furthermore, the sorter 30 is provided with the bag filter 32 which recovers the free material particles M which have been sorted. The bag filter 32 is connected to the mixing section 10 via the material supply tube 63, and the recovered material particles M are supplied to the mixing section 10. According to such a construction, the recovered material particles M can be easily returned to the aerosol generating system, and the material particles M can be reused easily.

Moreover, the transport tube 65 is arranged such that the end thereof, on the side of the collision net 41, as the terminal end of the transporting mechanism guiding the core particles C to the aerosol generating tank 40, is located at a position lower than the other end (the end on the cyclone 31), of the transport tube 65, located on the upstream side. Here, in order to separate the material particles M from the core particles C, the core particles C need to be collided against the collision net 41 with an appropriate collision force. For this purpose, a height different is provided between the terminal end of the transporting mechanism and a portion in front of the terminal end, and the falling speed at which the core particles C fall is controlled by appropriately setting the magnitude of the height different and by adjusting the height difference, the inclination of the transport tube 65, and/or the like. Accordingly, the collision speed at which the core particles C collide against the collision net 41 can be easily adjusted.

Furthermore, the aerosol generating tank 40 is provided with the recovery net 42 recovering the core particles C from which the material particles M have been separated. The recovery net 42 is connected to the mixing section 10, and the recovered core particle C are supplied to the mixing section 10. Accordingly, the recovered core particles C can be easily returned to the aerosol generating system, which in turn makes it easy to reuse the core particles C.

In addition, the mixing section 10 is provided with the down-slope which inclines downwardly in the predetermined direction, and a downward direction along the predetermined direction corresponds to the flow direction of the core and material particles C, M. According to such a construction, the material particles M and the core particles C roll down the down-slope together while making contact with each other. Therefore, the material particles M adhere over the surface of each of the core particles C substantially uniformly, and there is substantially no variation in the adhesion amount of the material particles M among the core particles. In addition, the material particles M firmly contact with the core particles C by the friction force and the pressure generated between the material particles M and the core particles C and/or between the inner wall of the mixing section 10 and the surfaces of the core particles. Consequently, it is possible to prevent the material particles M, once adhered to the core particles C, from exfoliating from the core particles C before reaching to the aerosol generating tank 40. This makes it possible to stably supply the material particles M by controlling the transport amount of the core particles C.

Further, the aerosol concentration detector 68 is provided on the aerosol supply tube 67 connecting the aerosol generating tank 40 and the ejection nozzle 51. Furthermore, the flow rate detector 11 which detects the flow rate of the core particles C is provided on the mixing section 10. According to such a construction, the detected aerosol concentration and the detected transport amount of the core particles C can be feed back to the controller 61 so as to adjust the transport amount of the core particles C, thereby making it possible to quickly respond to an unexpected fluctuation in the aerosol concentration.

Particles having a primary mean particle size of not more than 1 μm are used as the material particles M, and particles having a mean particle size of not less than 100 μm and not more than 200 μm are used as the core particles C. In this case, it is necessary that in the aerosol-generating step, among the core particles C and the material particles M which have been separated from each other, only the material particles M are made to fly in the gas so as to form the aerosol. For this purpose, it is necessary to set an appropriate size difference between the material and core particles M, C. When the core particles C are too small, the core particles C easily cause the clog-up in a passage such as the transporting mechanism, which in turn lowers the operation efficiency. Considering these situations, it is most appropriate that the core particles M have the primary mean particle size of not more than 1 μm; and that the core particles C have the mean particle size of not less than 100 μm and not more than 200 μm. Further, the porous material is used as the core particles C. With these, the material particles M enter into the fine pores of the core particles C and firmly fixed thereto, thereby making it possible to prevent the material particles M, once adhere to the core particles C, from exfoliating therefrom before reaching to the separating step. This can stabilize the supply amount of the material particles M by controlling the transport amount of the core particles C.

The technical scope of the present invention is not limited to the embodiment as described above, and includes, for example, the following construction as well as encompassing equivalent thereof.

In the embodiment as described above, the aerosol generating tank 40 is provided in which the separating section and the aerosol generator are integrally formed, and the collision net 41 is provided in the aerosol generating tank 40. It is allowable, however, that the separating section and the aerosol generator are independently provided and that the material particles separated from the core particles in the separating section are delivered to the aerosol generator to be aerosolized therein.

In the embodiment as described above, the fluidizer 20 and the sorter 30 are provided between the mixing section 10 and the aerosol generating tank 40. It is allowable, however, that only one of the fluidizer and the sorter is provided, or allowable to omit both of the fluidizer and the sorter.

In the embodiment as described above, the bag filter 32 is connected to the mixing section 10 via the material supply tube 63, and the recovered material particles M are re-supplied to the mixing section 10. It is allowable, however, that the bag filter and the mixing section are not connected with each other, and the recovered material particles are not returned to the aerosol generating system. Further, in the embodiment as described above, the recovery net 42 recovering the core particles C is provided on the aerosol generating tank 40, the recovery net 42 is connected to the mixing section 10, and the recovered core particles C are supplied to the mixing section 10. It is allowable, however, that the recovered core particles are not returned to the aerosol generating system.

In the embodiment as described above, the supply-adjusting valve 64 and the transport-adjusting valve 66 are automatically controlled by a command from the controller 61. However, the valve-opening adjustment may be performed manually. Alternatively, the mechanism for adjusting the opening of these valves is not limited to a mechanism of a type in which a horizontal plate is advanced/retracted, and the butterfly valve, ball valve, and the like can also be used.

In the embodiment as described above, the transport tube 65 is arranged to be obliquely inclined downward toward the downstream side. However, it is allowable that the end, of the transporting mechanism, on the side of the collision wall (downstream side) is arranged at a position lower than that of the other end, of the transporting mechanism, on the upstream side. For example, the transport tube may be arranged to extend vertically.

In the embodiment as described above, the mesh is used as the collision wall. However, the collision wall is not limited to the mesh and may be, for example, a plate having a slit formed therein in which the width of the slit allows the core particles pass therethrough. Similarly, instead of the collision net, a plate having a slit formed therein or the like can be used.

Figure 6:
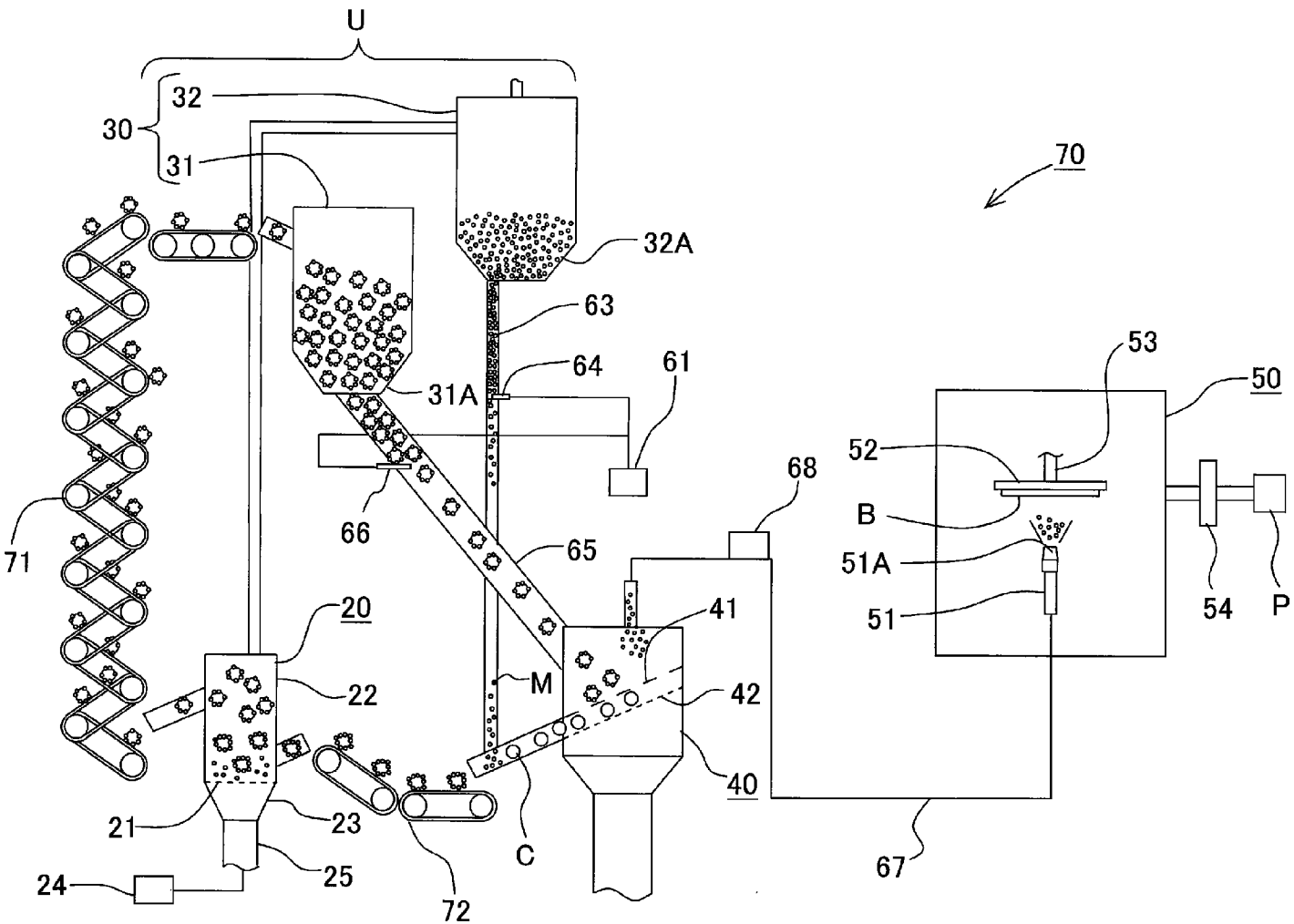
FIG. 6 is a schematic view of a film-forming apparatus according to another embodiment of the present invention.

In the embodiment as described above, the core particle C are delivered by airflow from the fluidizer 20 to the sorter 30 arranged at a position above the fluidizer 20. It is allowable, however, that the core particles C are delivered by a lift conveyer 71 provided on a film-forming apparatus 70 as shown in FIG. 6. Further, in the above-described embodiment, since the mixing section 10 is formed of a tube arranged in an inclined manner, the material particles M are made to adhere to the surfaces of the core particles C in the process in which the particles roll down in the downwardly inclined tube. Instead of this, a belt conveyer 72 may be arranged between the fluidizer 20 and the recovery net 42 of the aerosol generating tank 40. In this case, the material particles M can be firmly fix to the fine pores of the core particles C in a process in which the material and core particles M, C roll together on the belt conveyer 72.

Figure 7:
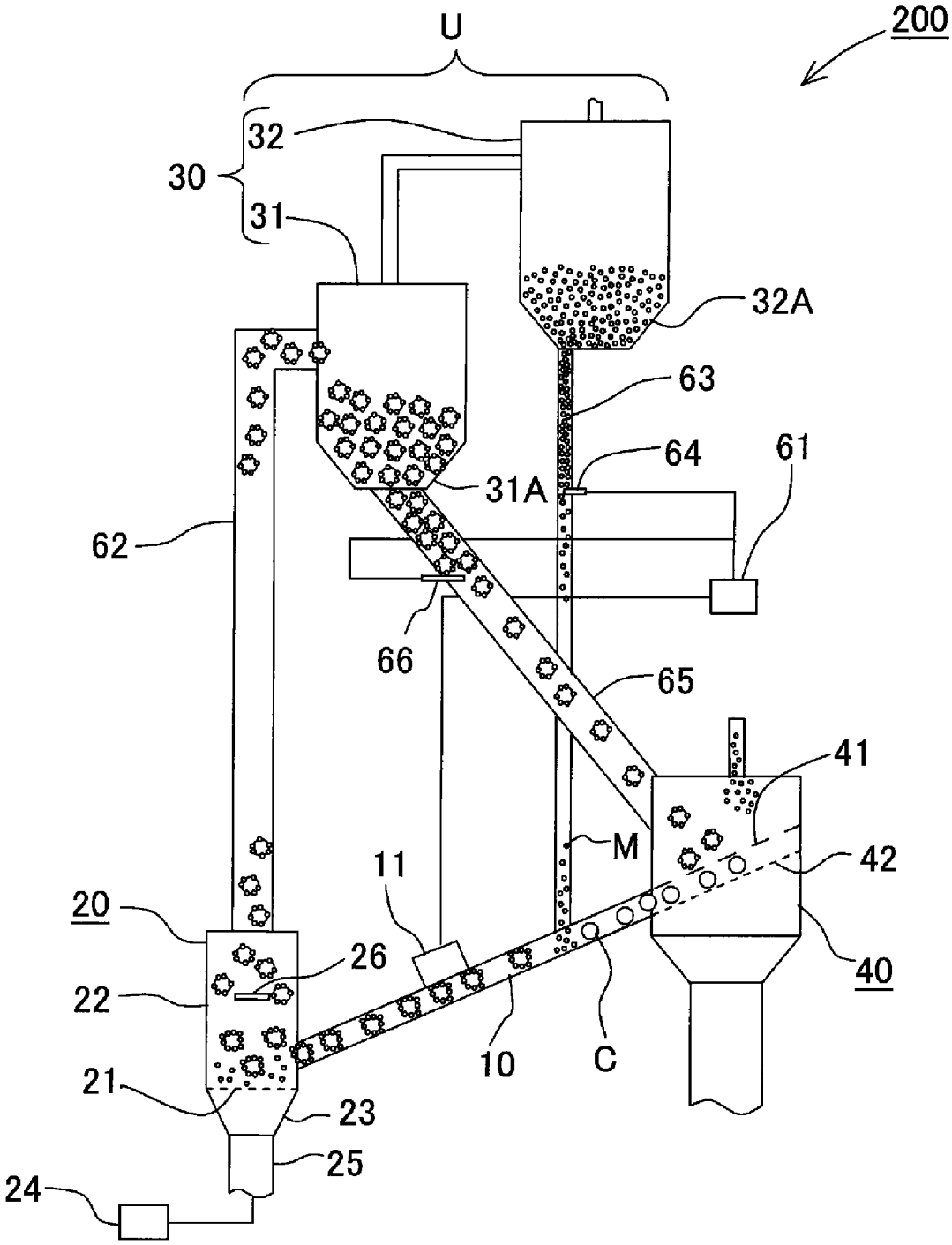
FIG. 7 is a schematic view of a particle-supplying apparatus of the present invention.

In the embodiment as described above, the material particles, separated in the separating section, are used for generating aerosol for the purpose of film formation. However, according to a particle-supplying apparatus 200 as shown in FIG. 7, material particles (first particles) separated from core particle (second particles) in a separating section 40 can be supplied for any purpose. This particle-supplying apparatus 200 has a similar construction as that of the film-forming apparatus 1 except that the particle-supplying apparatus 200 is not provided with the film-forming chamber 50 and the aerosol supply tube 67. Note that in the particle-supplying apparatus 200, it is allowable that any aerosol is not generated in the separating section 40. For example, it is allowable that the material particles passed through the recovery net 42 may be used as particles supplied from the particle-plying supplying apparatus. Alternatively, it is allowable that the fluidizer and/or separating section may be omitted in the particle-supplying apparatus.

What is claimed is:

1. A film-forming apparatus which forms a film, comprising:

a mixing section which mixes material particles for forming the film and core particles having a particle size greater than that of the material particles to adhere the material particles onto each of the core particles;

a separating section having a collision wall against which the core particles, each with the material particles adhered thereonto, collide to separate the material particles and the core particles;

a transporting mechanism which transports each of the core particles, onto each of which the material particles adhered, from the mixing section to the separating section;

a controller which is provided on the transporting mechanism and which controls a supply amount of the core particles to the separating section;

a fluidizer which generates a fluidized bed of the core particles and which is provided between the mixing section and separating section;

an aerosol generator which is connected to the separating section and which generates an aerosol by dispersing the material particles, separated from each of the core particles at the collision wall, in a carrier gas; and a nozzle which is connected to the aerosol generator and which ejects the aerosol.

2. The film-forming apparatus according to claim 1, wherein a sorter is provided between the mixing section and the separating section, the sorter sorting, from a mixture containing the core and material particles mixed in the mixing section, the core particles onto each of which the material particles are adhered and free material particles, among the material particles, which are free from the core particles.

3. The film-forming apparatus according to claim 2, wherein the sorter is provided with a material recovering section which recovers the free material particles sorted by the sorter and which is connected to the mixing section to supply the recovered free material particles to the mixing section.

4. A film-forming apparatus which forms a film, comprising:

a mixing section which mixes material particles for forming the film and core particles having a particle size greater than that of the material particles to adhere the material particles onto each of the core particles;

a separating section having a collision wall against which the core particles, each with the material particles adhered thereonto, collide to separate the material particles and the core particles;

a transporting mechanism which transports each of the core particles, onto each of which the material particles adhered, from the mixing section to the separating section;

a controller which is provided on the transporting mechanism and which controls a supply amount of the core particles to the separating section;

an aerosol generator which is connected to the separating section and which generates an aerosol by dispersing the material particles, separated from each of the core particles at the collision wall, in a carrier gas; and a nozzle which is connected to the aerosol generator and which ejects the aerosol, wherein the separating section is provided with a core recovering section connected to the mixing section, recovering the core particles from each of which the material particles have been separated, and supplying the recovered core particles to the mixing section.

5. The film-forming apparatus according to claim 4, wherein the collision wall is a mesh having a mesh size through which the core particles are passable; and the core recovering section includes another mesh having a mesh size through which the core particles are unable to pass.

6. A film-forming apparatus which forms a film, comprising:

a mixing section which mixes material particles for forming the film and core particles having a particle size greater than that of the material particles to adhere the material particles onto each of the core particles;

a separating section having a collision wall against which the core particles, each with the material particles adhered thereonto, collide to separate the material particles and the core particles;

a transporting mechanism which transports each of the core particles, onto each of which the material particles adhered, from the mixing section to the separating section;

a controller which is provided on the transporting mechanism and which controls a supply amount of the core particles to the separating section;

an aerosol generator which is connected to the separating section and which generates an aerosol by dispersing the material particles, separated from each of the core particles at the collision wall, in a carrier gas; and a nozzle which is connected to the aerosol generator and which ejects the aerosol, wherein the controller includes a first adjusting valve which adjusts a supply amount of the core particles to the separating section, and a second adjusting valve which adjusts a supply amount of the material particles to the mixing section.

7. The film-forming apparatus according to claim 6, wherein the transporting mechanism is connected to the separating section at a downstream-side portion of the transporting mechanism located at a position lower than that of an upstream-side portion thereof.

8. The film-forming apparatus according to claim 6, wherein the mixing section is formed to have a down-slope which is declined, in a predetermined direction, from a supply position at which one of the core and material particles are supplied; and the core and the material particles flow in the predetermined direction.

9. The film-forming apparatus according to claim 6, wherein an aerosol-concentration detector which detects a concentration of the aerosol is provided between the aerosol generator and the nozzle.

10. The film-forming apparatus according to claim 6, wherein the mixing section is provided with a flow-rate detector which detects a flow rate of the core particles.

11. The film-forming apparatus according to claim 6, wherein each of the first and second adjusting valves has a horizontal plate which adjusts a valve opening.

* * * * *